US005992210A

United States Patent [19]

Blurton-Jones

[11] Patent Number: 5,992,210

[45] Date of Patent: Nov. 30, 1999

[54] TUBE BENDING APPARATUS AND METHOD

[75] Inventor: Timothy J. Blurton-Jones, Puslinch, Canada

[73] Assignee: Eagle Precision Technologies Inc., Canada

[21] Appl. No.: 09/071,941

[22] Filed: May 5, 1998

[30] Foreign Application Priority Data

Nov. 17, 1997 [CA] Canada ..... 2221324

[51] Int. Cl.[6] ..... B21D 7/04

[52] U.S. Cl. ..... 72/702; 72/16.1; 72/16.3; 72/17.3; 72/149; 72/369

[58] Field of Search ..... 72/149, 369, 702, 72/15.1, 15.3, 16.3, 17.3, 31.04, 31.05, 31.1, 153, 155, 15.4, 16.7, 18.5

[56] References Cited

U.S. PATENT DOCUMENTS

| | | | |
|---|---|---|---|
| 4,979,385 | 12/1990 | LaFrasse et al. | 72/17.3 |
| 5,305,223 | 4/1994 | Saegusa | 72/149 |
| 5,481,891 | 1/1996 | Sabine | 72/369 |
| 5,535,611 | 7/1996 | Lilie | 72/702 |
| 5,797,289 | 8/1998 | Hosino | 72/17.3 |

FOREIGN PATENT DOCUMENTS

| | | | |
|---|---|---|---|
| 91/13706 | 9/1991 | WIPO | 72/702 |

*Primary Examiner*—Lowell A. Larson
*Assistant Examiner*—Ed Tolan
*Attorney, Agent, or Firm*—Farkas & Manelli PLLC; Edward J. Stemberger

[57] ABSTRACT

Apparatus and method for the bending of rigid workpieces, particularly tubes, such as those of use in automotive exhaust systems, heat exchangers and aircraft hydraulic systems. The apparatus comprises a workpiece clamping means for retaining the workpiece on the bending apparatus;

a pressure die means engageable with the workpiece;

a radius die means for providing a radius form about which the workpiece is bent, the radius die means being adapted to rotate about an axis for bending the workpiece about the radius die means to the bend angle;

a workpiece clamping die means for engaging and bending the workpiece relative to the pressure die means and about a portion of the radius die means;

control means for moving the clamping die means between a bend angle position in which the workpiece is bent about the radius die means to said bend angle relative to the clamping means and a relieved position in which the clamping die means is not bending the workpiece;

a workpiece displacement means for displacing said workpiece to a displaced position relative to said pressure die means and said clamping die means out of the engaging plane of said clamping die means by movement of said workpiece clamping means; and sensor means for sensing the free portion of the workpiece after the bending when the workpiece is in said displaced position and for sending a signal providing said sensing to the control means.

9 Claims, 7 Drawing Sheets

TUBE BENDING APPARATUS AND METHOD

FIELD OF THE INVENTION

This invention relates to apparatus and method for the bending of rigid workpieces, particularly tubes, such as those of use in automotive exhaust systems, heat exchangers and airdraft hydraulic systems.

BACKGROUND OF THE INVENTION

In prior apparatus used for the rotary draw bending of pipe and tube, such as of use in automobile exhaust systems, heat exchangers and aircraft construction, a primary component is the bending head of the apparatus. The bending head comprises a rotary bend die, an opposing clamp die which clamps a section of the tube immediately preceding the section of the tube where the bend is to be formed, and a pressure die located directly behind the clamped section of the tube. As the tube is pulled around the rotary bend die, the pressure die moves substantially in unison with the tube while resisting the radial reaction force of the tube action on the pressure die. Thus, the pressure die and rotary bend die cause the tube to be squeezed therebetween during the bending operation.

Many variable factors such as the type of tube material, tube wall thickness, shape of tube section to be formed, the radius of the bend and the like contribute to the "springback" characteristics of the tube and need to be considered when tube bending with rotary draw bending machine is carried out. However, although commercially acceptable tubes are manufactured with apparatus hereinbefore described, there is a need for pipe bending means which are capable of producing bent tubes of consistent quality on a repeated basis.

There are known apparatus having means available which can detect and compensate for the tube's springback characteristics. These apparatus are usually used after the tube is bent and unloaded from the bender to measure actual tube geometry compared to the desired tube geometry, such that the springback factor can be calculated and used to set the corrective bend angles needed to obtain the desired specified shape. Although these apparatus are effective, in practice there may be many iterations needed, with a high number of tubes being used, before the corrective springback factor is determined which results in increased tube scrap.

On some benders there are means for bend correction while the tube remains on the bender. In U.S. Pat. No. 5,275,031, issued Jan. 4, 1994, to Whiteside, J. A. et al., the bend correction means comprises a pressure die for holding a tube, a bend die for providing a radius form about which the tube is bent, and a clamping die for engaging and bending the tube relative to the pressure die and about a portion of the radius die. Control means moves the clamping die between a bend angle position in which the tube is bent about the radius die to a predetermined angle relative to angle position in which the tube is bent about the radius die to a predetermined angle relative to the clamping die and a relieved position in which the clamping die is not bending the tube. Sensor means, movable conjointly with the radius die, engages the tube in a springback position upon rotation of the radius die toward the tube and sends a signal to the control means upon contact with the tube. The control means then determines a rebend angle to achieve the desired degree of bend in the tube and moves the clamping die means and radius die to the rebend angle to bend the tube to that angle and storing the rebend angle for bending subsequent pieces. However, by having the sensor move conjointly with the radius die and having the radius die rotate until the sensor makes contact with the tube results in inaccurate position readings. Due to the sensitive nature of sensors, it will detect the location of the tube once it comes into contact with the tube. However, the contact location may not result in an accurate calculation of the actual tube angle if the sensor does not meet the tube at a flush 90 degree angle. By reason that the sensor is mounted on the bend die which rotates in an arc to make contact with the tube, it may not be possible for the sensor to make a 90 degree contact with the tube for all angle of bends. There is also the possibility that depending on the amount of springback of the tube, the sensor may not be able to make contact with the tube because it is firmly attached to the bend die. Further, due to the bending process itself there may be situations where lubricants are used on the tube around the bend die. These lubricants have the potential of clogging up the area where the sensor is mounted in the bend die to render the sensor ineffective or inaccurate.

Yet further, U.S. Pat. No. 5,275,031 corrects each angle of the tube through trial and error. If the specific angle is 30 degrees and the actual angle 27 degrees, produced on a first bend the angle at that portion of the tube will be rebent to an angle of greater than 30 degrees so that the relaxed state of the tube at that position will measure 30 degrees. In consequence, of the strain hardening nature of the materials, once a tube is bent, it is difficult to make minor adjustments to the bend. This strain hardening aspect of materials results in a bend angle error that is not compensated for in the control means calculation and may result in a final tube shape that does not correspond to the specified tube shape.

SUMMARY OF THE INVENTION

It is an object of the present invention to provide an apparatus for shaping a workpiece more accurately to an improved desired standard and readily adaptable to automatic operation.

It is a further object to provide said apparatus to provide the resultant desired bend specification to be obtained on the first and any subsequent tube pails and to reduce the numbers of scrap tubes.

It is a yet further object to provide a method of bending a tube to produce a bent tube having the aforesaid advantages.

These and other objects of the invention will become apparent from a reading of this specification as a whole.

Accordingly, in one aspect the invention provides a method of obtaining a desired bend angle when forming a workpiece subject to springback, the method comprising (a) bending the workpiece at a first part to a first bend with bending means comprising pressure die means for holding a workpiece, radius die means for providing a radius form about which the workpiece is bent, the radius die means being adapted to rotate about an axis for bending the workpiece about the radius die means to a first predetermined angle A, selected from a first significant value from said desired bend angle AF, and workpiece clamping die means for engaging and bending said workpiece relative to the pressure die means and about a portion of the radius die means;

(b) controlling said bending means by control means for moving the clamping die means between a bend angle position in which the workpiece is bent about the radius die means to said first predetermined angle relative to the clamping means and a relieved position in which the clamping die means is not bending the workpiece;

(c) sensing the free portion of the workpiece after said first bend by sensor means when said workpiece is in its relieved position and for sending a signal providing a first actual tube angle $A_1$ to said control means; said control means then determining a first springback value $S_1$; bending said workpiece at said first part to a second bend of a second predetermined angle $A_2$ selected from a second significant value from said desired bend angle AF and said first significant value and compensating for $S_1$; sensing the free portion of said workpiece after said second bend by said sensor means when said workpiece is in its relieved position and sending a signal providing a second actual workpiece angle $A_2$ to said control means; said control means then determining a second springback value $S_2$; bending said workpiece to said desired bend angle AF, compensated by $S_1$ and $S_2$.

By the term "first significant value" is meant a value selected sufficiently different from both of the desired bend angle AF and the second predetermined angle $A_z$ as to enable both of the first and second bending steps to provide meaningful, distinct springback values. Analogously, the "second significant value" is meant a value selected sufficiently different from the first significant value and desired bend angle AF to, similarly, provide a meaningful, distinct springback value. Thus, for a desired bend angle AF greater than, for example, say, 10–15°, a first significant value of, say 20–40% of AF, would be appropriate, and analogously a second significant value of say, 45–70% of AF may be selected. AF values less than 10–15°, due to the insensitivities of the instrumentation at these low bend angles, the method of the present invention is less preferred.

Thus, the invention requires (i) selecting the first and second significant values, (ii) bending the tube at a first part to the first significant value, optionally, compensated by a historical springback value, if known, (iii) measuring the actual bend angle obtained and determining a new first springback value, (iv) bending the tube further at the first part to the second significant value compensated by the first new springback value, (v) measuring the actual bend angle obtained and, optionally, historical springback value, if known, and determining a second new springback value; and finally bending the bend to the desired bend angle compensated by the first and second newly determined springback values and, optionally, the historical springback value, if known, and measuring the actual bend angle to yet further determine the refined springback angle.

Thus, the present invention in one aspect provides a method of determining accurate springback value for a particular workpiece after three ending operations at the same bend location. The refined springback value may then be used in selecting the predetermine bend angle for the next single bending operation at a second part of the workpiece to obtain the desired bend angle. Measurement of the actual bend angle obtained at the second part of the workpiece to provide a further refined springback value allows use of this further refined value in the single bending operation at any desired third part of the workpiece. This refinement process of obtaining the best springback value for a given workpiece may be continued for subsequent bending operations at different parts of the workpiece. Further, such refined springback value may be most advantageously used, directly, on all subsequent similar workpieces, undergoing either a single or multiple bending operation.

In an alternative embodiment of the invention, the refined springback value for a particular workpiece may be determined by the averaging of springback values obtained from a plurality of single bending operations on either different parts of the same workpiece or on a plurality of workpieces.

In a most preferred aspect of the present invention, in addition to determining refined springback values, allowance is made also to correct for any discrepancy in the overall shape of the workpiece from the desired shape in consequence of any imperfect bending operations. Thus, for a bending operation carried out at a second part of the workpiece after a first bend is made at a first part of the workpiece, compensation is made in the predetermined bend angle by using the refined springback value and a vector algebra algorithm to compensate by altering the length between adjacent bends.

Thus, in a preferred aspect the invention provides a method as hereinabove defined wherein the control means further determines a shape compensating factor angle $FL_1$ wherein $L_1$ is the axial distance between said first part and said second part of said workpiece, and is of use with springback factor $CS_1$ to determine a refined desired bend angle $BF^1$ compensated by $CS_1$ and $FL_1$; and bending said workpiece at said second part to said refined $BF^1$ and storing said $B^1$.

More preferred, the method further comprises sequentially, bending said workpiece at a third and fourth subsequent parts to desired bend angles CF and DF, respectively, wherein CF is compensated by springback factor $CS_2$ and DF is compensated by $CS_3$, respectively, and sensing the free portion of the workpiece by said sensor means when said workpiece is in its relieved position and for sending signal providing actual workpiece angle measurements CF and DF, respectively, to said control means; wherein said control means determines a fifth springback factor $S_5$ and compensating springback value $CS_3$ and a sixth springback factor $S_6$ and compensating springback value $CS_4$, respectively; and storing said $CS_4$ and said desired bend angles CF and $D_5$ compensated by said $CS_2$.

In an alternative aspect, the invention provides a workpiece bending apparatus for forming a workpiece to a bend angle, comprising a workpiece clamping means for retaining the workpiece on the bending apparatus;

a pressure die means engageable with the workpiece;

a radius die means for providing a radius form about which the workpiece is bent, the radius die means being adapted to rotate about an axis for bending the workpiece about the radius die means to the bend angle;

a workpiece clamping die means for engaging and bending the workpiece relative to the pressure die means and about a portion of the radius die means;

control means for moving the clamping die means between a bend angle position in which the workpiece is bent about the radius die means to said bend angle relative to the clamping means and a relieved position in which the clamping die means is not bending the workpiece;

a workpiece displacement means for displacing said workpiece to a displaced position relative to said pressure die means and said clamping die means out of the engaging plane of said clamping die means by movement of said workpiece clamping means; and sensor means for sensing the free portion of the workpiece after the bending when the workpiece is in said displaced position and for sending a signal providing said sensing to the control means.

The apparatus is readily adaptable for the automatic production of tubes bent to desired angles and shapes.

BRIEF DESCRIPTION OF THE DRAWINGS

In order that the invention may be better understood, a preferred embodiment will now be described by way of example only with reference to the accompanying drawings, wherein.

As discussed hereinabove, springback is the degree to which tube returns to its original shape after a bending or forming operation has been performed on it. The springback angle is the difference between the actual bend angle in a tube that has been freed at one end thereof and the desired pre-set degree of bend. For every bend made in the tube, its physical properties e.g. elastic nature forces bent portion of tube 1 to attempt to return it to its original shape due to the release of stress on the tube. Thus, to obtain a desired degree of bend, tube must be bent to an initial angle beyond the desired resultant degree of bend in order to compensate for the springback effect present in the tube.

Figure 1:
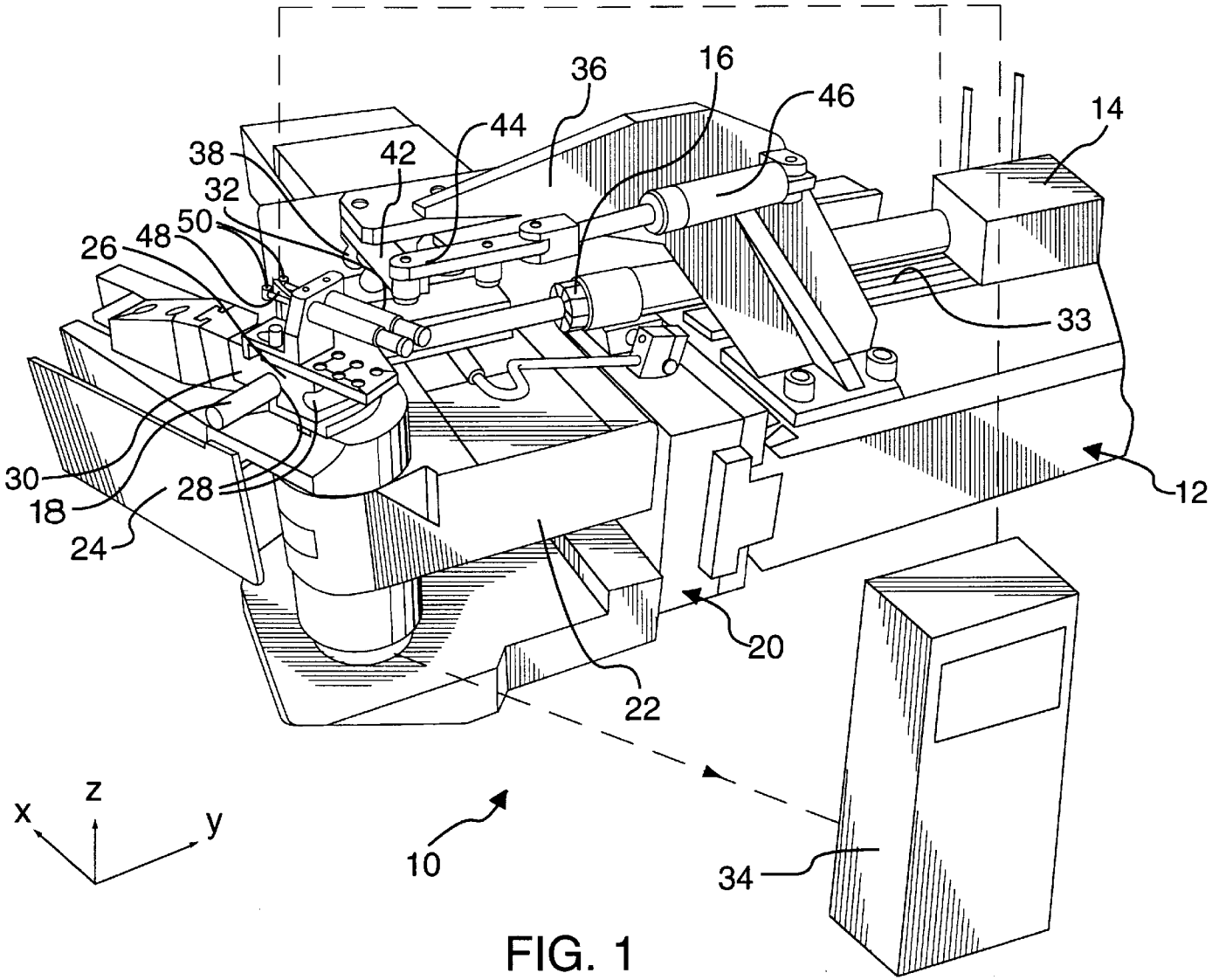
FIG. 1 is an isometric view of a tube bending apparatus according to the invention having a tube located in the apparatus for a bending operation.

FIG. 1 shows generally a bending machine 10 having a bending machine bed shown generally as 12 having a carriage 14 slidably mounted thereon and movable along a fixed longitudinal, Y, and a vertical axis, Z, and carrying a chuck 16 which holds a tube 18 that is to be bent. Tube 18 extends through chuck 16 and has a rear end (not shown) seated on a seat in carriage 14 in an arrangement that enables carriage 14 to press against the end of tube 18 and exert a longitudinal forwardly directed force thereon.

At the forward end of bed 12 is a bend head assembly shown generally as 20 having a stationary arm assembly 22 and a bend arm assembly 24. Bend arm assembly 24 is rotated by a suitable bend arm drive (not shown) about vertical axis Z and carries a radius bend die 26 having a groove 28 in which tube 18 is clamped by means of a clamp die 30 mounted on bend arm assembly 24 for motion toward and away from bend die 26. Stationary arm assembly 22 carries a pressure die 32 mounted in a bolster (not shown) that is driven transversely of tube 18 toward and away from bend die 26 by a pressure die cylinder (not shown). During a bending operation pressure die 32 is also driven forwardly, in a direction parallel to tube 18 axis by a pressure die boost cylinder (not shown).

Apparatus 10 described to this point is well-known, and, for example, is basically the same as the structure shown in U.S. Pat. No. 4,063,441 for Apparatus for Bending Tubes.

Figure 2:
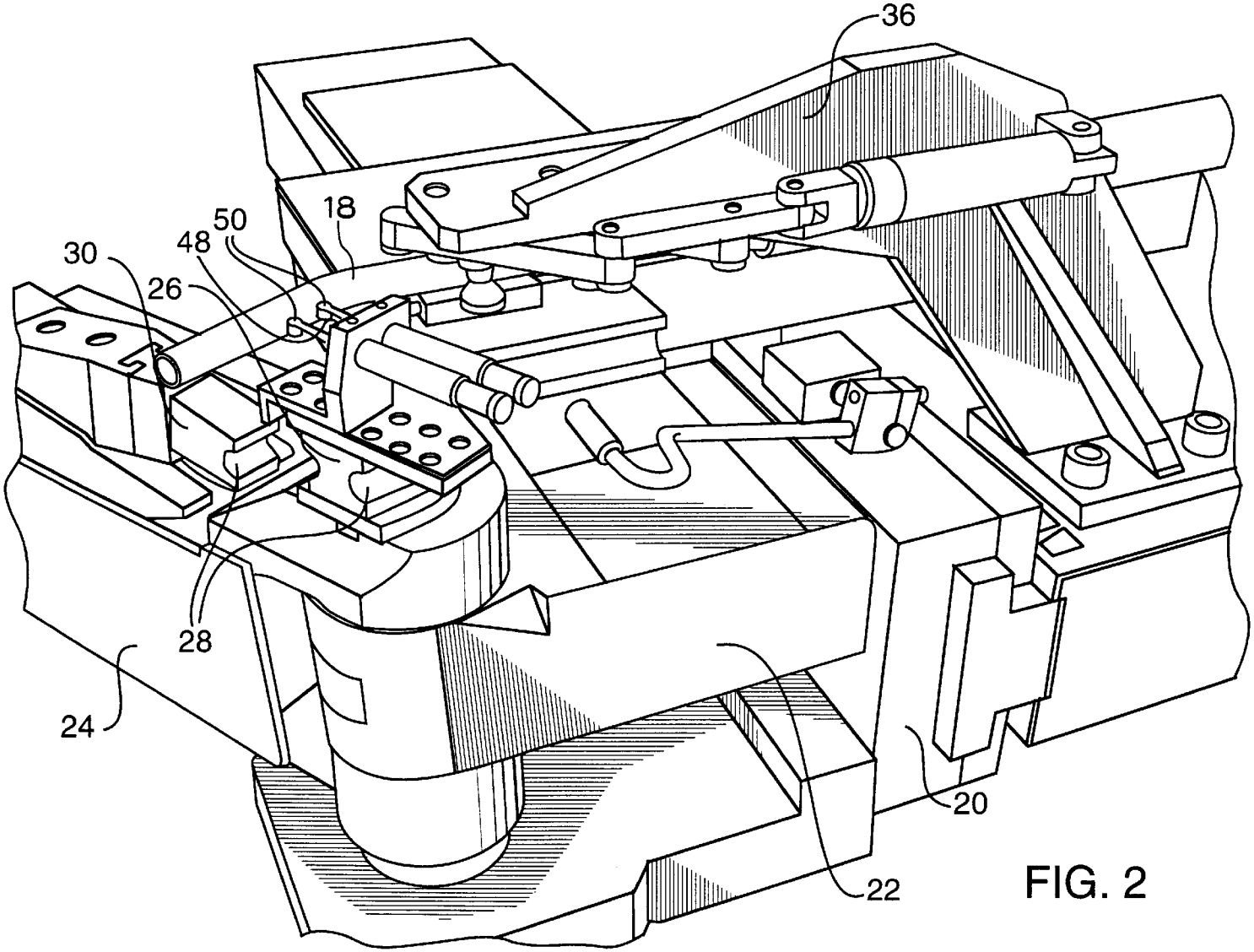
FIG. 2 is an isometric view of the embodiment shown in FIG. 1 wherein the tube has been removed from the bend die groove into the alignment unit for measurement.
Figure 3:
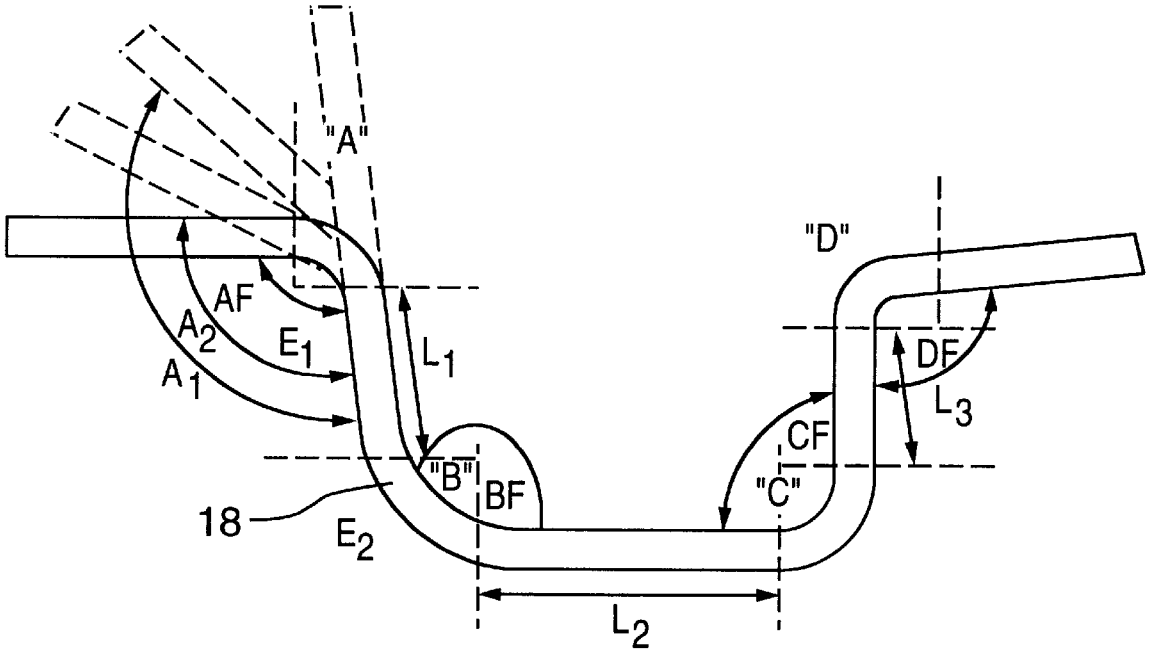
FIG. 3 is a schematic view of a tube having a plurality of bends obtained according to a method according to the invention.

Reference is now made to FIG. 2 in order to determine the springback value of use in the bending operation for the first bend "Afinal" in position "A" of tube 18 as illustrated in FIG. 2, Tube 18 is first bent to two lesser angles at position "A". These lesser angles are spaced incrementally hereinbefore termed first significant value and second significant value up to the desired final bend angle. For example, a specified desired bend angle of 90 degrees at position "A" results in the selection of two initial lesser angles being initially stepwise bent at position "A", preferably, at intermediate desired 30 degree and 60 degree. The two springback values that are determined from the bending steps at the two lesser angles, "A1", "A2" prior to subsequent bending "A", are used in refining the springback value for use in the final bend setting in obtaining the final desired first bend at position "A".

In use of apparatus 10 described to this point, tube 18 is mounted in rotatable chuck 16 and carriage 14 is advanced toward bend head 20 by operation of the carriage drive motor (not shown) until an end of tube 18 that is to be bent is properly positioned with respect to radius bend die 26. Clamp die 30 is moved toward tube 18 to clamp tube 18 tightly against radius bend die 26. Similarly, pressure die 32 is moved toward tube 18 to press tube 18 toward radius bend die 26. To perform a bend step, entire bend arm assembly 24, together with clamp die 30 and circular bend die 26, are rotated about vertical axis Z of radius bend die 26 to bend tube 18 around circular bend die 26, pulling tube 18 forwardly as radius bend die 18 rotates. During this bending operation, carriage 14 is free to slide along its guide rail. At the start of the bending operation pressure die 32 may also be driven forwardly by actuation of a pressure die boost cylinder (not shown). Because pressure die 32 also clamps a portion of tube 18 against bed die 26, forward motion of pressure die 32 frictionally engages tube 18 and drives tube 18 forward. When all forming blocks 24, 26 and 32 are in place relative to tube 18, bend tube 18 arm drive (not shown) begins to rotate bend arm 24 around bending vertical axis Z, and because bend die 26 and clamp block 30 are fixed to bending arm 24 they also rotate about the Z bending axis. This action pulls tube 18 around bending bend die 26 to form the bend. Once bend arm 24 rotates through to the specified bend axis location, a position sensor (not shown) feedbacks to controller 34 to discontinue the bend arm motion, at which time tube clamp die 30 disengages and moves back to its original prevent location. Tube 18 is now unclamped and its just-bent portion springs back due to the elastic nature of tube 18.

Figure 4:
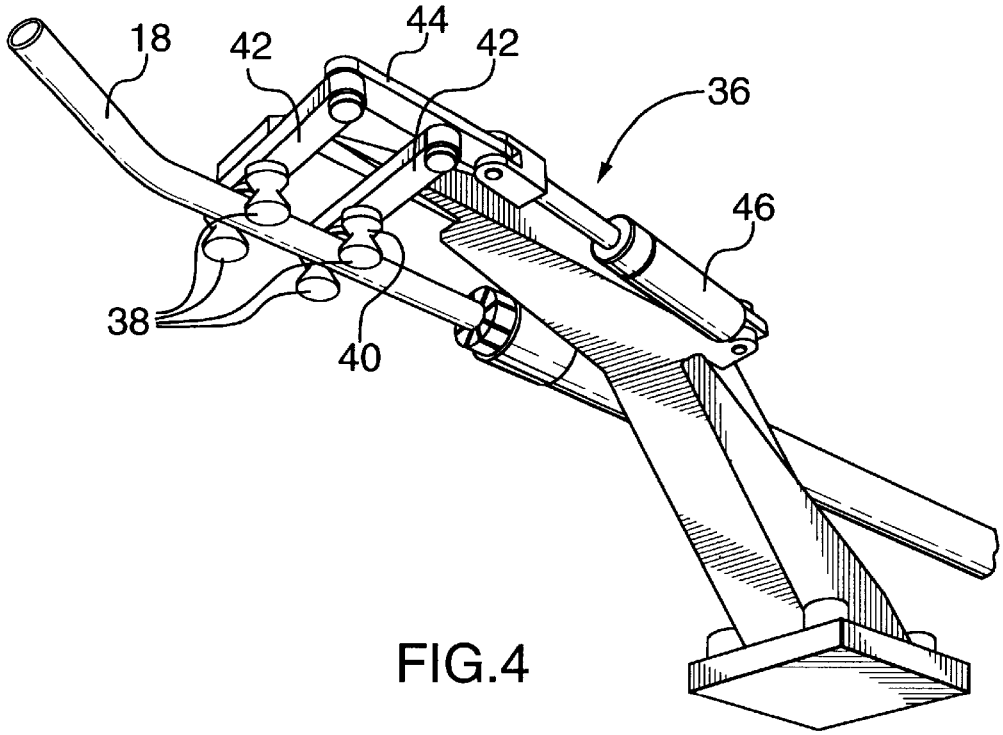
FIG. 4 is a schematic isometric view of an alignment unit holding the tube in an open, non-sensor measuring position.
Figure 5:
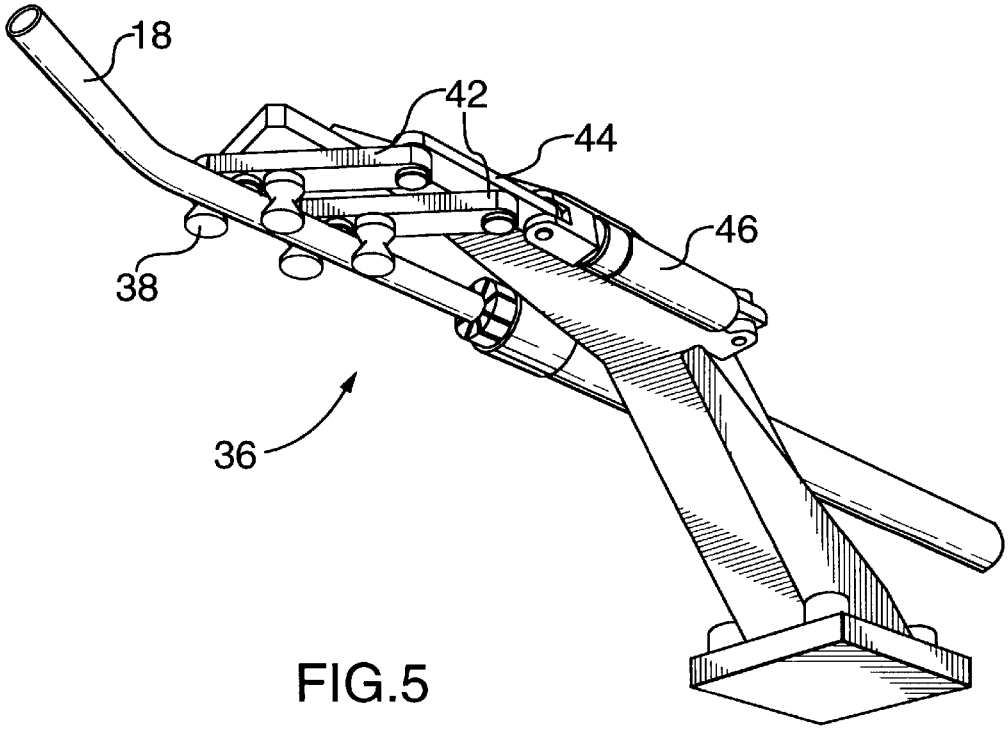
FIG. 5 is a schematic isometric view of the alignment unit holding the tube in a closed, sensor measuring position.

Tube 18 is brought clear of bend die groove 28 by a combination of movements of bend head 20 shifting sideways (X axis as depicted and forward from the position shown in FIG. 1) and carriage 14 moving in the Z axis as depicted on FIG. 1. With reference now to FIG. 2, tube 18 is moved through these X and Z movements such that it can be gripped by alignment unit, shown generally as 36 and rigidly mounted to bed 12. FIGS. 4 and 5 depict alignment unit 36 which has four rollers 38, each having a grooved radius 40 that matches the radius of tube 18. Each of the two sets of rollers 38 are attached to two linkage bars 42 having ends 44 attached to an actuator 46. To close and clamp rollers 38 onto tube 18, actuator 46 is activated which move linkages 42 and, thus, rollers 38 into an offset configuration that grips tube 18, as shown in FIG. 5. Once alignment unit 36 grips tube 18 such that it is positioned correctly along the Y axis, the tube bend angle is measured by measuring unit 48 mounted on bend die 26 and having a pair of linear displacement transducer sensors 50 that determine the positions of leading portions of tube 18 ahead of the bend. Through a series of X motions by bend head 20, Z motions by carriage 14 and the gripping of tube 18 by alignment unit 36, tube 18 is positioned where the leading portions tube 18 ahead of the bend can be measured by sensors 50. When tube 18 makes contact with sensors 50 there is a linear displacement of the transducers and displacement signals are sent to controller 34 that convert the readings to bend angles. The actual bend angle is then compared to the specified bend angle for the initial bend "A1 " to determine the springback value, "SA,1".

Once the bend angle measurement is taken, actuator 46 on alignment mechanism 36 is activated, retracts, and moves linkages 42 and rollers 38 to the open position. Then, through a series of Z axis moves by carriage 14 and X axis moves by bend head 20 tube 18 is returned to its exact location prior to tube 18 being extracted from bend die groove 28.

A second bending operation, "A2", is now performed on tube 18 prior to performing the desired bend. The sequence for obtaining the second bend angle "A2" is as described hereinabove wherein after the second bend step, tube 18 is extracted from bend die groove 28 and positioned such that it can be gripped by alignment unit 36 for measurement. The springback value, "SA,2" for the bend "A2" is sent to controller 34.

Figure 6A:
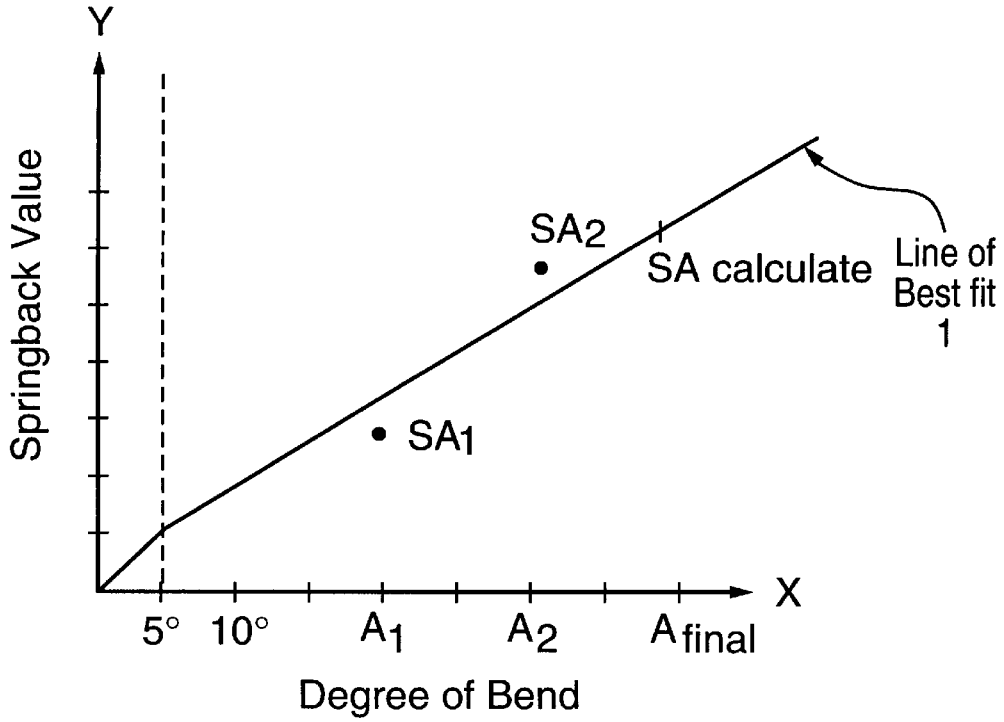
FIG. 6A and 6B are graphs of springback values against bend angles.

Controller 34 uses the springback values, "SA,1" for bend "A1" and "SA,2" for bend "A2" to determine a more accurate springback value for use in obtaining the specified bend angle "AF" at position "A" of the tube. To determine the springback value for use in determining the subsequent desired bend angle, controller 34 uses an algorithm akin to plotting the springback values on the chart as illustrated in FIG. 6A, with degrees defined along the X axis of the chart and springback values defined on the Y axis of the chart. With the two points obtained for bend angle "A1" and "A2" at position A of the tube, a line of its best fit is drawn for these two points. The line is used to determine the springback value, "SA, calculated" for use in obtaining the desired specified bend angle at position "A Final" of tube 18. As FIG. 6A illustrates, the algorithm does not extend the line directly to the Y axis of the chart, but drops off from about 5–10 degrees to the intersection point of the X and Y axis at (0,0). This drop off accounts for the fact that at lower angles, springback is a function more of the setup of apparatus 10 as opposed to the material properties of tube 18.

Figure 6B:
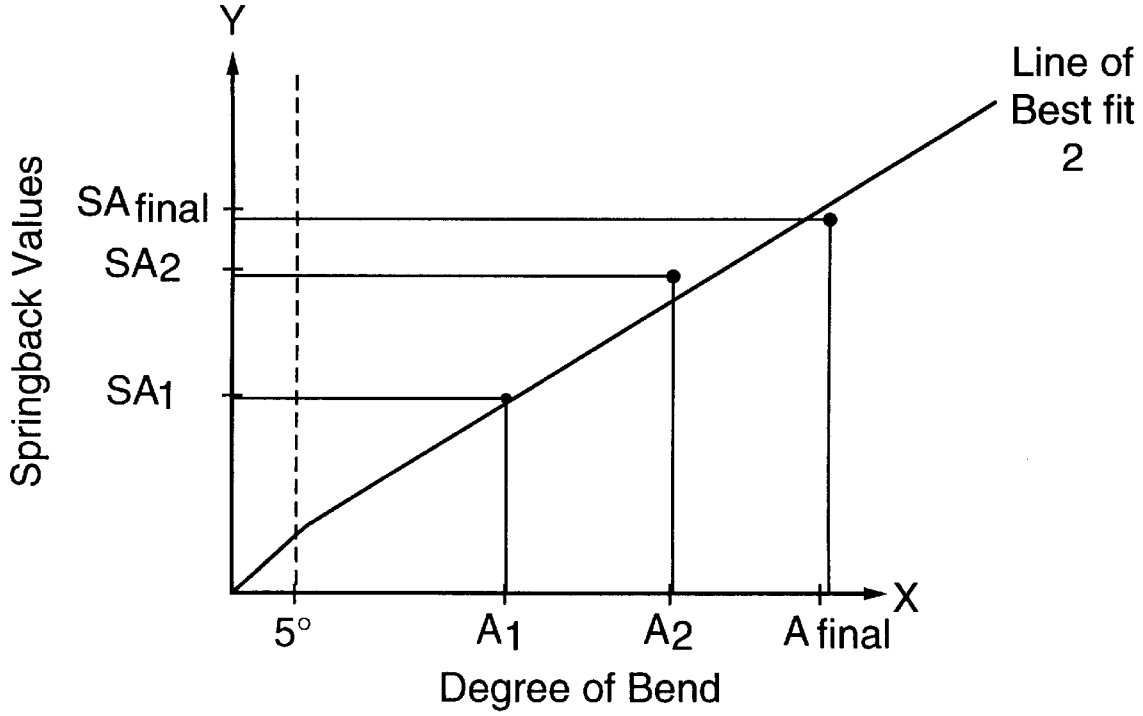

The bend, "A Final", at position A of tube 18 is now performed on tube 18. The sequence for obtaining bend "A Final" is as described hereinabove. The bend is obtained using the springback value "SA,calculated" derived from springback values "SA,1" and "SA,2" from the initial lesser bends "A1" and "A2". After the bending operation, tube 18 is extracted from bend die groove 28 and positioned such that it can be gripped by alignment unit 36 for measurement. The actual measured bend angle for bend "A Final" is compared against the desired bend angle at "A Final". Controller 34 then calculates the springback value "SA, Final" for final bend "A", and then takes the springback value, "SA Final" for the bend "A" and adds to the population of points for the chart as illustrated of FIG. 6B to include "SA,1, "SA,2" and "SA, Final". The control algorithm then uses these points to calculate the new line of best fit which is then used to better approximate the springback value to be used for the next bend at position "B" of tube 18, or for a first bend of a subsequent tube.

As the bending process moves to perform the specified bend at position "B" and for all subsequent bends at different locations on tube 18, the same sequence of bending and measurements of tube angles after each bend is performed. The springback value for each bend is then sent to controller 34 where it is added to the previous springback values to increase the population of points to further refine the line of best fit in obtaining the springback value for use in calculating the pre-set angle for the next bend.

As more bends are performed on the tube, the springback value becomes more accurate and, thus, allows tube bender 10 to produce bends at other positions along the tube e.g. positions "C" and "D" in the embodiment shown which closely matches the specified bend for each of those locations.

Although the springback values and, thus, the actual bends along the positions of the tube will become more true with each additional bend, any bend errors angle that are generated at each position along the tube may result in a final tube shape which is different from the specified overall tube shape.

To compensate for these errors, controller 34 uses a vector algebra algorithm to compensate by altering those lengths between adjacent bends, e.g. $L_1$, $L_2$, $L_3$ and angles "BF", "CF" and "DF" as shown in FIG. 2 and angles following the bend e.g. "AF" at the current position of tube 18. For example, after the final bending operation at position A of tube 18, any error E1 may have a resultant effect on the overall final shape of tube 18. Controller 34 analyzes error E1 and makes adjustments to the resultant lengths, such as $L_1$, $L_2$, $L_3$ and bends B, C and D to minimize the impact of error E1 to obtain the overall desired specified part shape. Similarly, after the bend at B any error E2 created is sent to controller 34, which analyzes the data and make adjustment to the resultant lengths, such as $L_2$ and $L_3$ and bends C and D to minimize the impact of error E2 to obtain the specified part shape. This process is repeated for each and all subsequent bends.

Figure 7A:
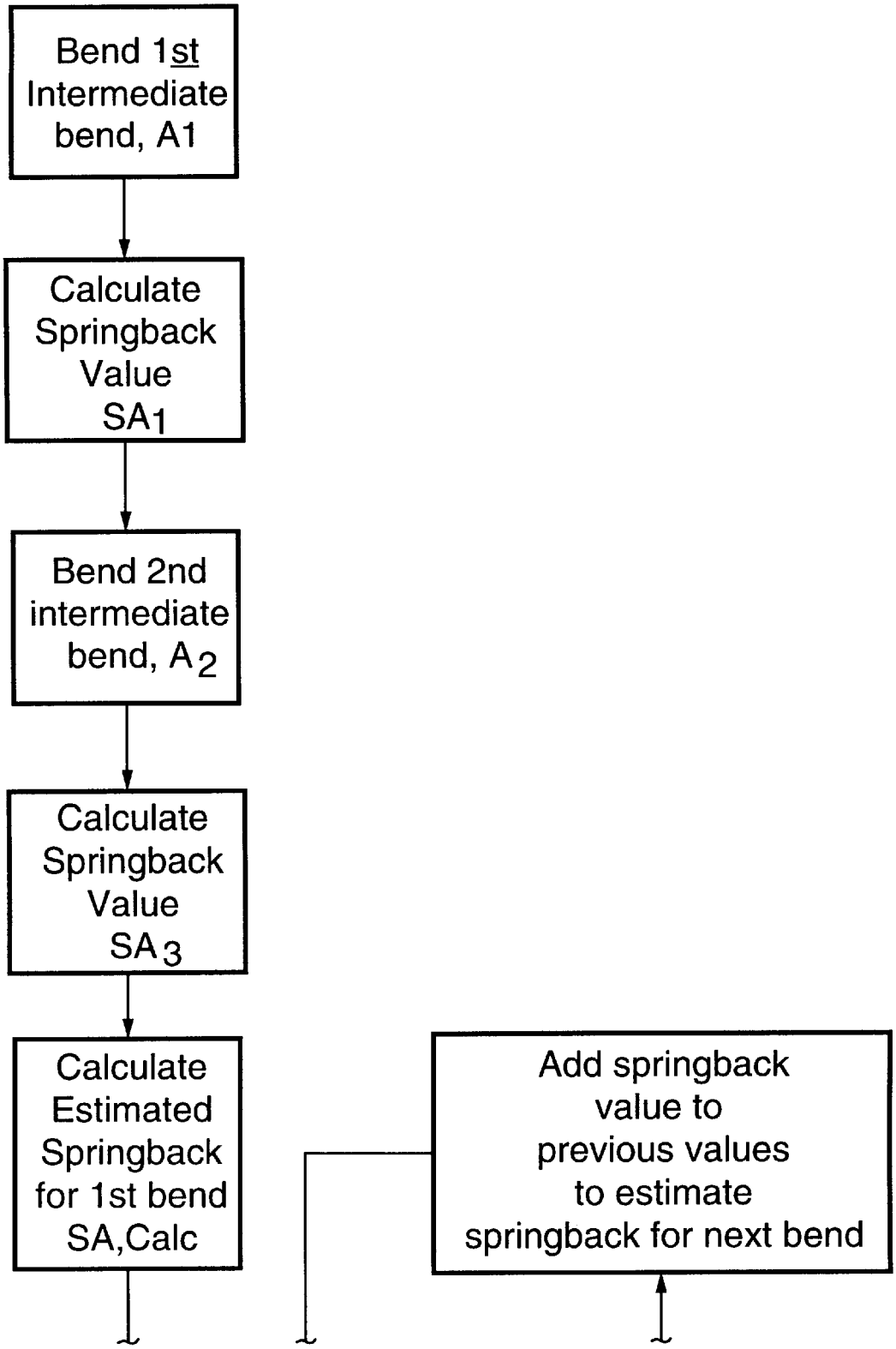
FIG. 7 represents a flow chart of the bending operations according to the invention; and wherein the same numerals denote like parts.
Figure 7B:
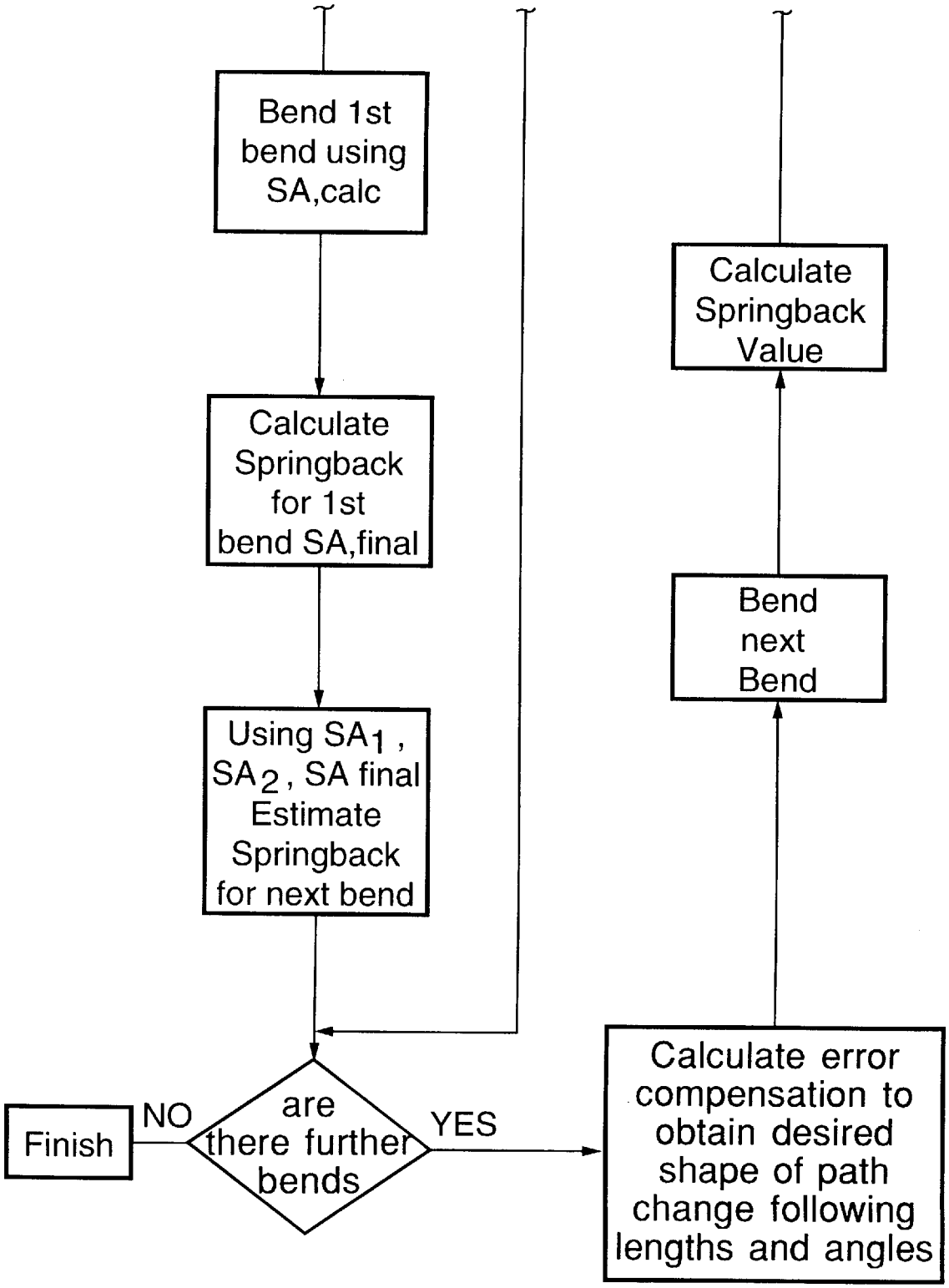

The flowchart on FIG. 7 illustrates the bending process for each tube.

Although this disclosure has described and illustrated certain preferred embodiments of the invention, it is to be understood that the invention is not restricted to those particular embodiments. Rather, the invention includes all embodiments which are functional or mechanical equivalents of the specific embodiments and features that have been described and illustrated.

I claim:

1. A method of obtaining a desired bend angle when forming in a bending apparatus a workpiece subject to springback, the method comprising:

(a) bending the workpiece at a first part to a first bend with bending means comprising pressure die means engageable with the workpiece, radius die means for providing a radius form about which the workpiece is bent, the radius die means being rotatable about an axis for bending the workpiece about the radius die means to a first predetermined angle A, selected from a first significant value from said desired bend angle AF, workpiece clamping die means for engaging and bending the workpiece relative to the pressure die means and about a portion of the radius die means and workpiece clamping means for retaining the workpiece on the bending apparatus;

(b) controlling said bending means by control means for moving the clamping die means between a bend angle position in which the workpiece is bent about the radius die means to said first predetermined angle relative to the clamping means and a relieved position in which the clamping die means is not bending the workpiece;

(c) sensing the free portion of the workpiece after the first bend by sensor means when the workpiece is in its relieved position and for sending a signal providing a first actual tube angle $A_1$ to said control means; said control means then determining a first springback value $S_1$; bending said workpiece at said first part to a second bend of a second predetermined angle $A_2$ selected from a second significant value from said desired bend angle AF and said first significant value and compensating for $S_1$; sensing the free portion of said workpiece after said second bend by said sensor means when said workpiece is in its relieved position and sending a signal providing a second actual workpiece angle $A_2$ to said control means; said control means then determining a second springback value $S_2$ bending said workpiece to said desired bend angle AF, compensated by $S_1$ and $S_2$;

(d) sensing the free portion of the workpiece after said third bend by said sensor means when said workpiece is in its relieved position and sending a signal providing a third actual workpicce angle $A_3$ to said control means; said control means then determining a third springback value $S_3$ and a compensating springback value $CS_1$ of use in further bending said workpiece or subsequent tubes and storing said compensating values $CS_1$ and said desired bend angle $A_1$ compensated by $CS_1$;

(e) (i) bending said workpiece at a second part to a desired bend angle BF compensated by springback factor $CS_1$;

(ii) sensing the free portion of the workpiece by said sensor means when said workpiece is in its relieved position and for sending a signal providing actual workpiece angle measurement BF to said control means; said control means then determining a fourth springback factor $S_4$ and a compensating springback value $CS_2$ of use in further bending said workpiece or subsequent workpiece, and storing said $CS_2$ and said desired bend angle compensated by $CS_2$; wherein said control means further determines a shape compensating factor angle $FL_1$ wherein $L_1$ is the axial distance between said first part and said second part of said workpiece, and is of use with springback factor $CS_1$ to determine a refined desired bend angle $BF^1$ compensated by $CS_1$ and $FL_1$; and bending said workpiece at said second part to said refined $BF^1$ and storing said $BF^1$.

2. A method as defined in claim 1 further comprising, sequentially, (iii) bending said workpiece at a third and fourth subsequent parts to desired bend angles CF and DF, respectively, wherein CF is compensated by springback factor $CS_2$ and DF is compensated by $CS_3$, respectively, (iv) sensing the free portion of the workpiece by said sensor means when said workpicce is in its relieved position and for sending signal providing actual workpiece angle measurements CF and DF, respectively, to said control means; wherein said control means determines a fifth springback factor $S_5$ and compensating springback value $CS_3$ and a sixth springback factor $S_6$ and compensating springback value $CS_4$, respectively; and storing said $CS_4$ and said desired bend angles $D_5$ compensated by said $CS_2$.

3. A method as defined in claim 2 wherein said control means further determine a shape compensating factor angle $FL_2$, wherein $L_2$ is the axial distance between said second part and said third part of said workpiece, and is of use with springback factor $CS_2$ to determine a refined desired bend angle $CF^1$ compensated by $CS_2$ and $FL_2$; and bending said workpiece at said third part to said $CF^1$; and storing said $CF^1$.

4. A method as defined in claim 3 wherein said control means further determines a shape compensating factor angle $FL_3$, wherein $L_3$ is the axial distance between said third part and said fourth part of said workpiece, and is of use with springback factor $CS_3$ to determine a refined desired bend angle $DF_1$ compensated by $CS_3$ and $FL_3$; and bending said workpiece at said third part to said $DF^1$; and storing said $DF^1$.

5. A workpiece bending apparatus for forming a workpiece to a bend angle, comprising:

a workpicce clamping means for retaining the workpiece on the bending apparatus;

a pressure die means engageable with the workpiece;

a radius die means for providing a radius form about which the workpiece is bent, the radius die means being rotatable about an axis for bending the workpiece about the radius die means to the bend angle;

a workpiece clamping die means for engaging and bending the workpiece relative to the pressure die means and about a portion of the radius die means;

control means for moving the clamping die means between a bend angle position in which the workpiece is bent about the radius die means to said bend angle relative to the clamping means and a relieved position in which the clamping die means is not bending the workpiece;

a workpiece displacement means for displacing said workpiece to a displaced position relative to said pressure die means and said clamping die means out of the engaging plane of said clamping die means by movement of said workpiece clamping means;

sensor means for sensing the free portion of the workpiece after the bending when the workpiece is in said displaced position and for sending a signal providing said sensing to the control means;

a bed;

a bed carriage horizontally, slidably mounted on and vertically moveable from said bed carriage;

said workpiece clamping means cooperable with said carriage;

said alignment means rigidly held to said bed and comprising a plurality of opposing workpiece retaining members for releasably retaining the workpiece in the displaced position;

an actuator means for effecting retention within desired alignment and release from the retaining members of the workpiece;

said retaining means adapted to received said workpiece in desired alignment by vertical movement of said workpiece clamping means and horizontal movement of said radius die means relative to said bed, and wherein said sensor means is mounted at a position to sense the free portion of the tube ahead of the tube bend in the horizontal plane of the alignment retaining members.

6. Apparatus as defined in claim 5 further comprising alignment means for retaining and aligning the workpiece in said displaced position.

7. Apparatus as defined in claim 5 wherein said workpiece clamping means is moveable in a plane substantially perpendicular to said holding plane of the clamping die means.

8. Apparatus as defined in claim 7 wherein said workpiece clamping means is moveable in a vertical plane.

9. Apparatus as defined in claim 8 wherein said workpiece clamping means is moveable in a horizontal plane.

* * * * *